US011276935B2

(12) United States Patent
Rabah et al.

(10) Patent No.: US 11,276,935 B2
(45) Date of Patent: Mar. 15, 2022

(54) DIPOLE ANTENNA APPARATUS AND METHOD OF MANUFACTURE

(71) Applicant: AIRSPAN IP HOLDCO LLC, Boca Raton, FL (US)

(72) Inventors: Hassanein Daniel Rabah, Slough (GB); David Clive Taylor, Oakley (GB); Richard Brooke Keeton, Lymington (GB)

(73) Assignee: AIRSPAN IP HOLDCO LLC, Boca Raton, FL (US)

( * ) Notice: Subject to any disclaimer, the term of this patent is extended or adjusted under 35 U.S.C. 154(b) by 0 days.

(21) Appl. No.: 17/025,959

(22) Filed: Sep. 18, 2020

(65) Prior Publication Data

US 2021/0091475 A1 Mar. 25, 2021

(30) Foreign Application Priority Data

Sep. 20, 2019 (GB) ..... 1913572

(51) Int. Cl.
*H01Q 1/24* (2006.01)
*H01Q 9/28* (2006.01)
(Continued)

(52) U.S. Cl.
CPC ..... *H01Q 9/285* (2013.01); *H01Q 5/48* (2015.01); *H01Q 19/108* (2013.01);
(Continued)

(58) Field of Classification Search
CPC ..... H01Q 9/285; H01Q 5/48; H01Q 19/108; H01Q 21/062; H01Q 13/10; H01Q 1/273
See application file for complete search history.

(56) References Cited

U.S. PATENT DOCUMENTS 5,757,326 A * 5/1998 Koyama ..... H01Q 1/22 343/702
2004/0222937 A1 11/2004 Gottl et al.
(Continued)

FOREIGN PATENT DOCUMENTS

CN 102315515 A 1/2012
CN 103022641 A 4/2013
(Continued)

OTHER PUBLICATIONS

EP Search Report in EP20194609.2 dated Jan. 26, 2021, 28 pages.
UK Search Report in GB1913572.2 dated Mar. 12, 2020, 15 pages.

*Primary Examiner* — Joseph J Lauture
(74) *Attorney, Agent, or Firm* — Haynes Beffel & Wolfeld LLP; Andrew Dunlap

(57) ABSTRACT

A dipole antenna apparatus, and method of manufacture of such an apparatus, are provided. The antenna apparatus has a conductive plate extending in a first plane, and a pair of conductive elements arranged to form a dipole antenna, where the pair of conductive elements are located in a second plane parallel to the first plane. Each conductive element forms a conductive ring in the second plane that surrounds a non-conductive inner area. The first conductive element in the pair of conductive elements has a conductive bridge extending across the conductive ring to divide the non-conductive inner area into at least two portions. A conductive connection then extends from the conductive bridge to the conductive plate. As a result, in normal use the conductive plate acts as a reflector for the dipole antenna, but in the event of a direct current event the presence of the conductive bridge and the conductive connection causes the conductive plate to operate as a ground plane for direct current within the first conductive element of the dipole
(Continued)

antenna. It has been found that such an approach provides a particularly efficient, low cost, design for a dipole antenna.

18 Claims, 11 Drawing Sheets

(51) Int. Cl.

| | |
|---|---|
| ***H01Q 5/48*** | (2015.01) |
| ***H01Q 19/10*** | (2006.01) |
| ***H01Q 21/06*** | (2006.01) |
| *H01Q 13/10* | (2006.01) |
| *H01Q 1/27* | (2006.01) |

(52) U.S. Cl.
CPC ..... *H01Q 21/062* (2013.01); *H01Q 1/273* (2013.01); *H01Q 13/10* (2013.01)

(56) References Cited

U.S. PATENT DOCUMENTS

| | | | |
|---|---|---|---|
| 2007/0241983 | A1 | 10/2007 | Cao et al. |
| 2011/0057852 | A1 | 3/2011 | Holland et al. |
| 2014/0176386 | A1 | 6/2014 | Rentz |
| 2016/0248171 | A1 | 8/2016 | John et al. |
| 2018/0323513 | A1 | 11/2018 | Varnoosfaderani et al. |

FOREIGN PATENT DOCUMENTS

| | | | |
|---|---|---|---|
| CN | 104157961 | A | 11/2014 |
| CN | 106058416 | A | 10/2016 |
| CN | 106684543 | A | 5/2017 |
| CN | 107611569 | A | 1/2018 |
| CN | 109994817 | A | 7/2019 |
| CN | 110233332 | A | 9/2019 |

* cited by examiner

Full assembly (Section view)

Full assembly (3D view)

DIPOLE ANTENNA APPARATUS AND METHOD OF MANUFACTURE

BACKGROUND

The present technique relates to the design of a dipole antenna apparatus, and a method of manufacturing such a dipole antenna apparatus.

In many applications, such as radio and telecommunications, a dipole antenna is a very commonly used class of antenna. For example, a dipole antenna is one of the most common elements used in base station antenna arrays. A dipole antenna is a balanced structure in terms of input impedance, and does not require an additional feeding network. Moreover, when placed above a metallic reflector, the antenna becomes directional.

Whilst the above properties make dipole antennas very attractive for use in applications such as base station antenna arrays, it is highly desirable for the dipole antennas to be cheap and easy to manufacture. One common way to produce a dipole antenna is using a printed circuit board (PCB) design, since such designs can be cheap to manufacture and easy to tune. However, they can suffer from poor radiation efficiency due to the losses in the dielectric materials.

It is also important in many applications to provide appropriate direct current (DC) grounding, so as to enable the dipole antenna to be protected from events such as lightning strikes, which can result in significant direct current passing through the dipole antenna.

SUMMARY

In one example arrangement, there is provided an antenna apparatus comprising: a conductive plate extending in a first plane; a pair of conductive elements arranged to form a dipole antenna, the pair of conductive elements located in a second plane parallel to the first plane, and each conductive element forming a conductive ring in the second plane that surrounds a non-conductive inner area; a first conductive element in the pair of conductive elements having a conductive bridge extending across the conductive ring to divide the non-conductive inner area into at least two portions; and a conductive connection extending from the conductive bridge to the conductive plate; whereby in normal use the conductive plate acts as a reflector for the dipole antenna, but in the event of a direct current event the presence of the conductive bridge and the conductive connection causes the conductive plate to operate as a ground plane for direct current within the first conductive element of the dipole antenna.

In another example arrangement, there is provided a method of constructing an antenna apparatus comprising: providing a conductive plate extending in a first plane; positioning a pair of conductive elements in a second plane parallel to the first plane to form a dipole antenna, and shaping each conductive element so as to form a conductive ring in the second plane that surrounds a non-conductive inner area; providing a first conductive element in the pair of conductive elements with a conductive bridge extending across the conductive ring to divide the non-conductive inner area into at least two portions; and forming a conductive connection extending from the conductive bridge to the conductive plate, such that in normal use the conductive plate acts as a reflector for the dipole antenna, but in the event of a direct current event the presence of the conductive bridge and the conductive connection causes the conductive plate to operate as a ground plane for direct current within the first conductive element of the dipole antenna.

BRIEF DESCRIPTION OF THE DRAWINGS

The present technique will be described further, by way of illustration only, with reference to examples thereof as illustrated in the accompanying drawings, in which.

DESCRIPTION OF EXAMPLES

Figure 1:
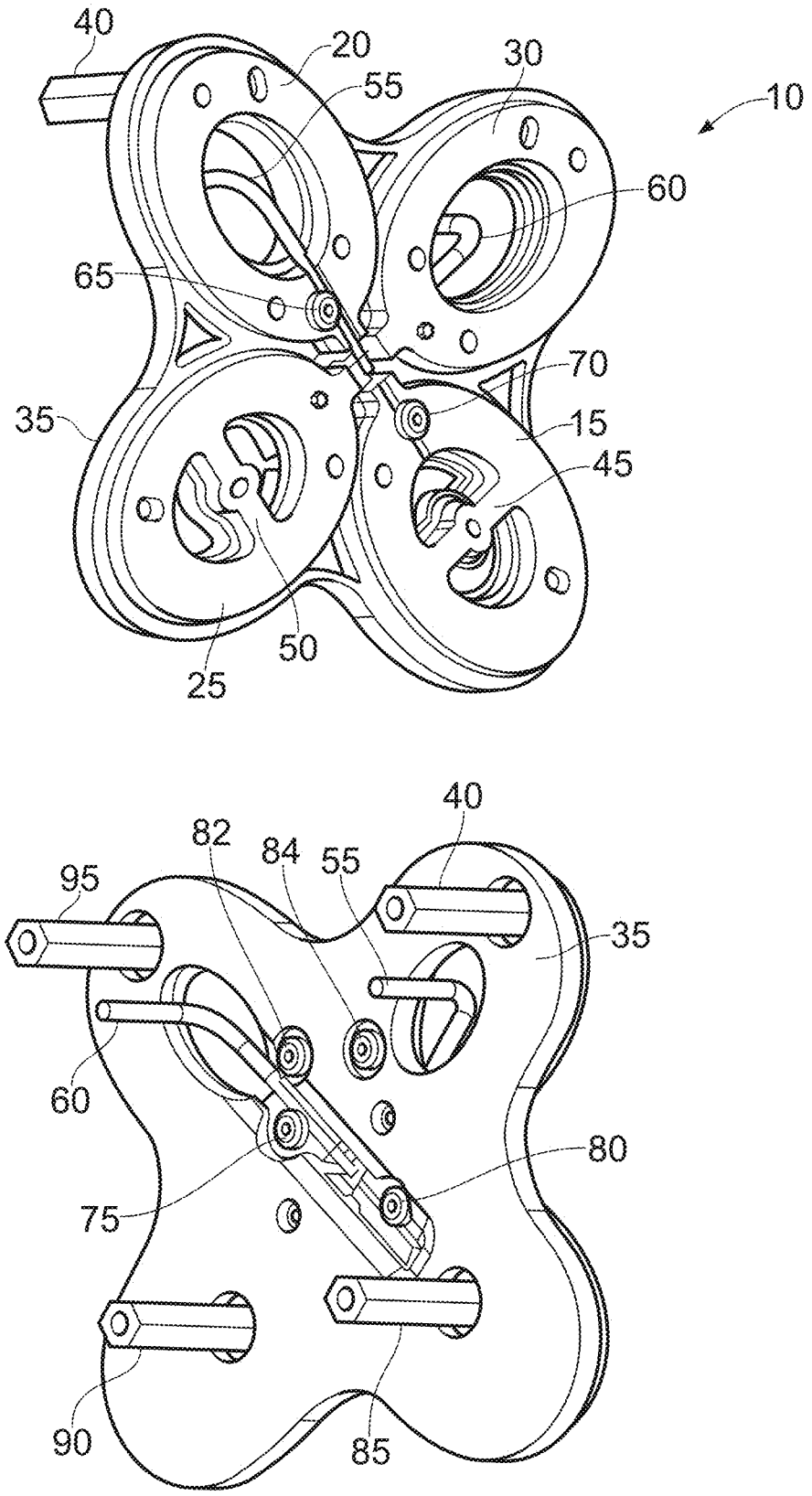
FIG. 1 schematically illustrates the arrangement of a dual polarised dipole antenna in accordance with one example arrangement.

In accordance with one example configuration an antenna apparatus is provided that has a conductive plate extending in a first plane, and a pair of conductive elements that are arranged to form a dipole antenna, where the pair of conductive elements are located in a second plane parallel to the first plane. By such an arrangement, the conductive plate can act as a reflector for the dipole antenna, thereby enabling the antenna to be used as a directional antenna.

In accordance with the techniques described herein, each conductive element forms a conductive ring in the second plane that surrounds a non-conductive inner area. The non-conductive inner area may be filled with a non-conductive solid material, but in one example is a hollow area and hence may typically contain air.

A first conductive element in the pair of conductive elements is arranged to have a conductive bridge extending across the conductive ring that divides the non-conductive inner area into at least two portions. In one specific implementation the bridge extends between opposing sides of the ring to sub-divide the non-conductive area into two portions.

A conductive connection is then provided that extends from the conductive bridge to the conductive plate. As a result, in normal use the conductive plate acts as a reflector for the dipole antenna. However, in the event of a direct current event, such as for example may be caused by a lightning strike, the presence of the conductive bridge and the conductive connection causes the conductive plate to operate as a ground plane for direct current within the first conductive element of the dipole antenna.

It has been found that such an approach provides a particularly efficient mechanism for providing DC grounding functionality within an antenna apparatus by allowing the conductive plate that is used as a reflector for the dipole antenna to also be used to provide a DC grounding path. In accordance with the design, the first conductive element in the pair of conductive elements is provided with a conductive path to the reflector. However, by arranging the pair of conductive elements as conductive rings, and providing the conductive connection from the conductive plate to the first conductive element such that that connection is made on the conductive bridge extending across the conductive ring, it has been found that a suitable radiation pattern for the dipole antenna can be maintained despite the presence of the connecting path between the conductive plate and the first conductive element.

It has been found that such an approach can lead to a very efficient antenna design that is simple to manufacture, can provide directional behaviour, and can provide robust DC grounding functionality.

Whilst the conductive plate, conductive elements and conductive connection can be formed of a variety of materials, in one example implementation each of those parts are provided by metallic components.

The conductive connection that extends from the conductive bridge of the first conductive element to the conductive plate can be provided in a variety of ways. However, in one example implementation the antenna apparatus has a separation structure that is used to hold the pair of conductive elements apart from the conductive plate, and thus ensure that the pair of conductive elements are maintained in a plane parallel to the plane of the conductive plate. In one such implementation, the separation structure itself can also be used to provide the conductive connection, thereby avoiding the need to provide an additional structure to implement the conductive connection.

For example, the separation structure may provide a metallic rod extending from the conductive plate to the conductive bridge to provide the conductive connection. It should be noted that in the implementations described herein no such conductive connection is made with the second conductive element. In one example implementation the separation structure may also include a rod extending from the conductive plate to the second conductive element, but that rod can be formed of a non-metallic material so that an electrical connection is not made between the second conductive element and the conductive plate.

In one example implementation, the pair of conductive plates are located on a non-conductive support structure. This can simplify manufacture, with the non-conductive support structure effectively being used to define the plane in which the pair of conductive elements are located. However, in one such implementation it is then necessary for the above-mentioned metallic rod to pass through the non-conductive support structure so as to make an electrical connection with the conductive bridge of the first conductive element. In one example implementation this is achieved by shaping the metallic rod so as to clamp the non-conductive support structure between an abutment surface of the metallic rod and the first conductive element whilst a portion of the metallic rod extends through the non-conductive support structure to connect to the conductive bridge of the first conductive element. By such an approach, the metallic rod not only makes the required electrical connection, but also serves to hold the first conductive element against the non-conductive support structure.

The non-conductive support structure can be formed of a variety of different materials, but in one example implementation a low cost plastic material is used.

It should be noted that by using a design of dipole antenna as discussed above, where the pair of conductive elements used to form the dipole antenna are formed of conductive rings that are either self-supported or supported on a non-conductive support structure, this allows a low cost dipole antenna to be produced, whilst avoiding the need to use PCB materials. Hence, the design avoids the losses that are typically associated with dielectric materials, and hence improves the radiation efficiency relative to equivalent PCB based dipole antennas.

In one example implementation, the second conductive element in the pair of conductive elements could be constructed identically to the first conductive element, and hence have a conductive bridge extending across the conductive ring. However, there would be no conductive connection made between the conductive bridge of the second conductive element and the conductive plate so as to ensure that the second conductive element is electrically isolated from the first conductive element. Such an approach could improve the radiation pattern due to the identical nature of the two conductive elements. However, in practice it has been found that a suitable radiation pattern can be obtained even when the second conductive element is not provided with the conductive bridge, and as will be discussed in more detail later, by avoiding the need for a conductive bridge in the second conductive element, this can provide routing benefits with regard to the feedline cable used to connect to the dipole antenna.

Hence, in one example implementation the second conductive element in the pair of conductive elements is not provided with the conductive bridge. However, the first and second conductive elements are shaped in the second plane such that the first conductive element has an equivalent electrical length to the second conductive element despite the provision of the conductive bridge in the first conductive element. Electrical length refers to the length of an electrical conductor in terms of the phase shift introduced by transmission over that conductor at some frequency. Whilst the provision of a conductive bridge in one of the conductive elements and not in the other has the potential to alter the electrical length of one conductor relative to the other, it has been found that by appropriate shaping of the conductive elements the potential effect of the conductive bridge can be removed. It will be appreciated by those skilled in the art that there are a number of factors that will affect the electrical length, and in one example implementation one or more of the width of the metal forming the conductive ring, the width of the conductive bridge and/or the size of the holes provided by the non-conductive inner area can be adjusted so that both the first and second conductive elements have the same equivalent electrical length, thus ensuring efficient operation of those conductive elements as a dipole antenna.

In one example implementation, during operation surface current flows through the first and second conductive elements. Each of the first and second conductive elements has a fundamental current mode defined by the conductive ring, and this current mode can also be referred to as a surface current mode since the electrical current exists only on the surface. The presence of the conductive bridge creates at least one additional current mode (surface current mode) in the first conductive element. However, the first conductive element is shaped so as to restrict an effect of the at least one additional current mode on the electrical length of the first conductive element, and hence it can be ensured that both the first and second conductive elements have an equivalent electrical length despite the provision of the conductive bridge within the first conductive element.

In one example implementation, a feedline cable that is used to connect to both of the conductive elements is routed into the non-conductive inner area of one of the conductive elements in the pair of conductive elements. This can allow for an efficient and slimline design by allowing a portion of the feedline cable to be accommodated within the unused inner area of one of the conductive elements.

In one particular example implementation, the second conductive element is not provided with the conductive bridge and the feedline cable is routed into the non-conductive inner area of the second conductive element. Due to the absence of the conductive bridge, this provides a very flexible space into which to accommodate the feedline cable.

In one particular implementation, an end portion of the feedline cable that is used to make electrical connections with both the first and second conductive elements is arranged to extend parallel to the second plane. By enabling that end portion to extend parallel to the second plane, this can avoid the presence of that end portion of the feedline cable creating any electrical field components perpendicular to the second plane in which the dipole antenna is provided, and hence further improves efficiency of the design.

There are a number of ways in which the end portion of the feedline cable can be accommodated so as to extend parallel to the second plane. In one example implementation, the second conductive element has a channel provided therein to accommodate a first part of the end portion of the feedline cable, and an electrical connection is made between the second conductive element and the first part in the channel. A second part of the end portion of the feedline cable then extends beyond the channel to make an electrical connection to the first conductive element. This provides a very simple and efficient mechanism for making the necessary connections between the feedline cable and the two conductive elements forming the dipole antenna.

In one example implementation, a mechanical fixing mechanism is used to make the electrical connections of the feedline cable to the first and second conductive elements. In particular, by arranging for the end portion of the feedline cable to be routed through a channel in the second conductive element and then on to the first conductive element in a direction parallel to the surface of the first conductive element, suitable mechanical fixings can be readily accommodated in the design without affecting the dimensions of the overall design. For example, one or more metallic screws can be used to clamp the first part of the end portion of the feedline cable within the channel of the second conductive element, and the second part of the end portion may then for example extend into a recess in the first conductive element, where it can also be clamped using a metallic screw. Such an approach avoids the need for a plating process or additional surface finishing process that may be required if instead one were to seek to establish a solder connection between the feedline cable and the conductive elements.

The feedline cable is in one example implementation a coaxial cable comprising an inner conductor, and an outer conductor insulated from the inner conductor. The inner conductor may be electrically connected to the first conductive element, whilst the outer conductor is connected to the second conductive element. Hence, it will be appreciated that the technique described herein provides a very efficient and robust mechanism for providing DC grounding for the inner conductor of a coaxial cable by making use of a connection to the conductive plate that is already provided to act a reflector for the dipole antenna. Whilst a number of other techniques can readily be used to provide grounding functionality for the outer conductor of the coaxial cable, it has traditionally been difficult to provide a simple and effective grounding for the inner conductor, but the use of the techniques described herein allows for such a grounding of the inner conductor to be achieved in a simple and low cost manner without affecting the overall dimensions of the antenna design.

The conductive rings can be formed in a variety of ways. In one example the conductive rings are solid in a depth dimension of the first and second conductive elements perpendicular to the second plane. Hence, the conductive rings can be made of solid parts, for example made of conductive metal. Such parts can be made using a variety of different processes, for example a diecast process or CNC (Computer Numerically Controlled) machining. As discussed earlier, a coaxial cable used to provide the feedline cable can then be connected to the rings using metallic screws to ensure the electrical connection.

However, in an alternative implementation the first and second conductive elements are made of thinner conductive material, which can be produced using a cost effective manufacturing process such as stamping or pressing technology. In particular, due to the physical principle derived from Coulomb's law, the electrical field inside the metal is zero and thus it is possible to hollow out the dipole arms from the inside without affecting the radiation characteristics. Hence, in one example implementation, the first and second conductive elements have an edge defining an element depth in a depth dimension perpendicular to the second plane, and the conductive rings are provided by a surface region of the first and second conductive elements, where the surface region has a depth less than the element depth. With such an arrangement (referred to herein as a "stamped" implementation), due to the loss of solid material in the depth dimension perpendicular to the second plane, it will typically be necessary to solder the required feedline cable to the inner side of the metallic parts forming the first and second conductive elements of the dipole antenna.

Whilst in one example implementation the antenna apparatus may include a single dipole antenna, in an alternative implementation two dipole antennas can be incorporated into the design so as to provide a dual polarised dipole antenna apparatus. Hence, in such an arrangement the earlier-mentioned dipole antenna becomes a first dipole antenna, and the antenna apparatus further comprises an additional dipole antenna comprising a pair of conductive elements that are also located within the second plane. The additional dipole antenna can be arranged to have a different orientation within the second plane than the first dipole antenna so as to provide a dual polarised antenna apparatus. Typically, the two different dipole antenna antennas will be arranged at 90 degrees to each other so as to provide orthogonal polarisation.

In one example implementation, the pair of conductive elements forming the additional dipole antenna are constructed identically to the pair of conductive elements forming the first dipole antenna. It has been found that the above described arrangement of each dipole antenna can lead to a very efficient design, offering wide operational bandwidth performance, good antenna directivity, and strong isolation between the different antenna ports of the dual polarised antenna. The antenna can be accommodated in a small area and manufactured cheaply.

As discussed earlier, it can be desirable for the end portion of the feedline cable for a dipole antenna to be received parallel to the second plane in which the dipole antenna is accommodated. When providing a dual polarised antenna design including two dipole antennas, it is desirable to allow the feedline cable for each dipole antenna to extend parallel to the second plane, but to ensure that the routing of one feedline cable is not compromised by the presence of the other feedline cable. In one example implementation, this is achieved by provision of a suitable feedline cable receiving structure within the conductive elements and by inverting one or both conductive elements of one dipole antenna relative to their equivalent conductive elements in the other dipole antenna. In particular, in one example implementation the pair of conductive elements have a depth dimension perpendicular to the second plane, and at least one of the pair of conductive elements has a feedline cable receiving structure offset from a central location in the depth dimension. The at least one of the pair of conductive elements forming the additional dipole antenna is inverted with respect to the corresponding at least one of the pair of conductive elements forming the first dipole antenna to facilitate connection of a first feedline cable to the first dipole antenna and connection of a second feedline cable to the additional dipole antenna such that end portions of both the first and second feedline cables extend parallel to the second plane but are separated with respect to each other by a determined distance perpendicular to the second plane.

The feedline cable receiving structure can take the form of the earlier discussed channel in one example implementation, and by offsetting the channel relative to the central location in the depth dimension of the second conductive element this means that when the second conductive element of one dipole antenna is inverted with respect to the second conductive element of the other dipole antenna, the channels do not occupy the same plane parallel to the second plane, but instead occupy different planes in the depth dimension, hence allowing the feedline cables to pass over/under each other, and thus allowing the end portion of both feedline cables to be maintained in a parallel relationship to the second plane.

An offset receiving structure could also be provided in the first conductive elements. However, in an alternative implementation, all that is required in the first conductive element is a hole suitable to receive the inner conductor at one end of the feedline cable so that it can be clamped into the hole using the metallic screw. If desired, two offset holes could be provided in the first conductive element, so that the first conductive element does not need to be inverted, and instead the first conductive element in one dipole antenna will have the feedline cable connected to the first one of the two holes, whilst the equivalent first conductive element in the other dipole antenna will have its feedline cable connected to the other of the two holes.

By arranging the pair of conductive elements as discussed above, it has been found that this enables one single tool to be used to create the conductive elements used for both dipole antennas, since the conductive elements of both dipole antennas can be constructed identically, with the use of inversion of one or more of the conductive elements enabling efficient connecting of the required feedline cables.

Whilst the above approach can be used for the implementations where each of the dipole antenna arms is formed a solid ring of uniform depth, when using the earlier discussed "stamped" implementation the first and second conductive elements forming each dipole antenna will not be inverted, since it is only the upper surface of the first and second conductive elements that provide the conductive rings. Instead, the routing holes required to pass the feedline cables through the conductive elements to the point at which they are soldered to those conductive elements can be altered in the depth dimension between the conductive elements used for one dipole antenna and the conductive elements used for the other dipole antenna. Alternatively, each conductive element can be provided with two sets of holes separated in the depth dimension, such that one of the holes can be used for the feedline cable of the first dipole antenna and the other of the holes can be used for the feedline cable for the other dipole antenna.

Particular examples will now be described with reference to the figures.

FIG. 1 illustrates a dipole antenna apparatus in accordance with one example configuration. In particular, in this example configuration, the dipole antenna apparatus includes a pair of dipole antennas used to provide a dual-polarised dipole antenna arrangement. The top part of FIG. 1 shows the apparatus from a topside view, whilst the lower figure shows an underside view. In both views, a conductive plate on which the apparatus shown in FIG. 1 is mounted is omitted for clarity. A first dipole antenna is formed by the two conductive elements 15, 20, whereas a second dipole antenna is formed by the equivalent pair of conductive elements 25, 30. As shown in FIG. 1, each conductive element is essentially ring shaped, and in particular forms a conductive ring that surrounds a non-conductive inner area. In this example, the non-conductive inner area is hollow, and in one example implementation is filled with air (or optionally another gas if the antenna apparatus is placed within a housing filled with a gas other than air).

As seen in FIG. 1, the first conductive element 15, 25 of the pair of conductive elements forming each dipole antenna has a conductive bridge 45, 50 extending across the gap formed by the non-conductive inner area of the conductive ring.

In the example shown in FIG. 1, the four conductive elements are metal and may be formed for example from a diecast process or by CNC machining. In such implementations, the conductive bridge 45, 50 is formed of the same metal as the conductive rings, and produced during the process of manufacturing the conductive rings. As also shown in FIG. 1, the various conductive elements are supported on a non-conductive support structure 35, which could for example be formed of a plastic material.

As shown by the underside view in FIG. 1, conductive rods 85, 90 can be passed through the non-conductive support structure 35 to connect to the central portion of the conductive bridges 45, 50 of the first conductive elements 15, 25. Similarly, non-conductive rods 40, 95 can be used to pass through the non-conductive support structure 35 to attach to the second conductive elements 20, 30 of each dipole antenna. The four rods 85, 90, 40, 95 serve to hold the various conductive elements above a conductive plate, in one example implementation the conductive plate being formed as a metal plate. As a result, when considering the conductive plate as extending in a first plane, the various conductive elements 15, 20, 25, 30 can be seen as occupying a second plane parallel to the first plane.

The rods 85, 90, 40, 95 can also be shaped so that they include an abutment surface that serves to clamp the non-conductive support structure 35 against the overlying conductive elements 15, 20, 25, 30, hence serving to hold the various conductive elements and support structure in place. If desired, a number of additional screws such as the screws 82, 84 can also be used to clamp the non-conductive support structure to the conductive elements.

However, in addition to using the rods 85, 90, 40, 95 to provide a separation structure to maintain a parallel separation between the conductive plate and the four conductive elements forming the two dipole antennas, by arranging for the rods 85, 90 to be made of a conductive material, for example being formed as metal rods, this establishes an electrical connection between the conductive bridges 45, 50 of the first conductive elements 15, 25 and the conductive plate. During normal operation, there is alternating current (AC) flowing around the conductive rings and the presence of the electrical connecting path to the conductive plate can be arranged so that it does not adversely affect operation of the dipole antenna elements. In particular, the first and second conductive elements forming each dipole antenna can be shaped such that the first conductive element has an equivalent electrical length to the second conductive element despite the provision of the conductive bridge in the first conductive element.

It will be appreciated that various properties can affect the electrical length of the conductive rings, and hence for example the width of the metallic ring in the second plane can be altered, as can the width of the conductive bridge 45, 50, and indeed the size of the holes provided within the ring, so as to vary the electrical length. During normal operation there will be a fundamental current mode defined by the conductive ring due to current flowing around the ring on the surface. The presence of the conductive bridge will create at least one additional current mode in the first conductive elements, but the first conductive elements can be shaped so as to restrict an effect of the at least one additional current mode on the electrical length of the first conductive elements so as to ensure that the first conductive elements have an equivalent electrical length to the second conductive elements. As a result, the presence of the conductive bridge 45, 50, and the conductive path to the underlying conductive plate, will not cause an adverse effect on the operation of each dipole antenna in normal use.

However, in the event of a direct current (DC) event, such as may occur during a lightning strike, the presence of the conductive bridge 45, 50 and connected metallic rods 85, 90 provide a DC path to the conductive plate, thus providing effective DC grounding for the feedline connection made to the first conductive elements 15, 25 (as will be discussed in more detail later), such a feedline connection typically being formed by the inner conductor of a coaxial cable. This hence provides a very simple and effective mechanism for providing sufficient DC grounding without requiring additional wiring and infrastructure within the antenna design.

As also shown in FIG. 1, the second conductive element 20, 30 can be formed with a channel therein to accommodate an end portion of the feedline cable used to connect to each dipole antenna. Hence, considering the first dipole antenna formed by the two conductive elements 15, 20, the feedline cable 55 can be routed through the gap formed by the conductive ring of the second conductive element 20, with the end portion of the feedline cable then being passed parallel to the second plane (i.e. parallel with the plane accommodating the various conductive elements forming the two dipole antennas). A first part of the end portion is then routed through the channel provided by the second conductive element, and can be electrically connected to the second conductive element by a screw 65. A second part of the end portion of the feedline cable can then extend beyond the channel in order to be received in a hole in the first conductive element, where it can also be clamped into position using a metallic screw 70. In one example implementation the feedline cable 55 is a coaxial cable, with the outer conductor being connected to the second conductive element 20, and the inner conductor being connected to the first conductive element 15 of the dipole antenna.

As shown by the underside view in FIG. 1, an equivalent routing can be made for the feedline cable 60 associated with the second dipole antenna, with the screws 75, 80 providing the equivalent functionality to the screws 65, 70 discussed above, but for the second dipole antenna.

The channel can be formed within the second conductive element so that it exists off centre with respect to the depth dimension of the second conductive element. As a result, the second conductive element 30 used for the second dipole antenna can be inverted relative to the second conductive element 20 used for the first dipole antenna so that the first feedline cable 55 can be routed across the top surface shown in the topside view of FIG. 1, whilst the second feedline cable 60 can be routed along the bottom surface as shown by the underside view in FIG. 1. The first conductive elements 15, 25 can be formed with receiving holes for the feedline cable that are at different positions in the depth dimension with respect to each other, or instead both of those conductive elements can be constructed identically with two holes that are offset in the depth dimension, one near the upper surface and one near the bottom surface. As a result, no inversion of the first conductive elements is required, and the feedline cable can merely be received in the appropriate hole provided within those conductive elements.

Figure 2:
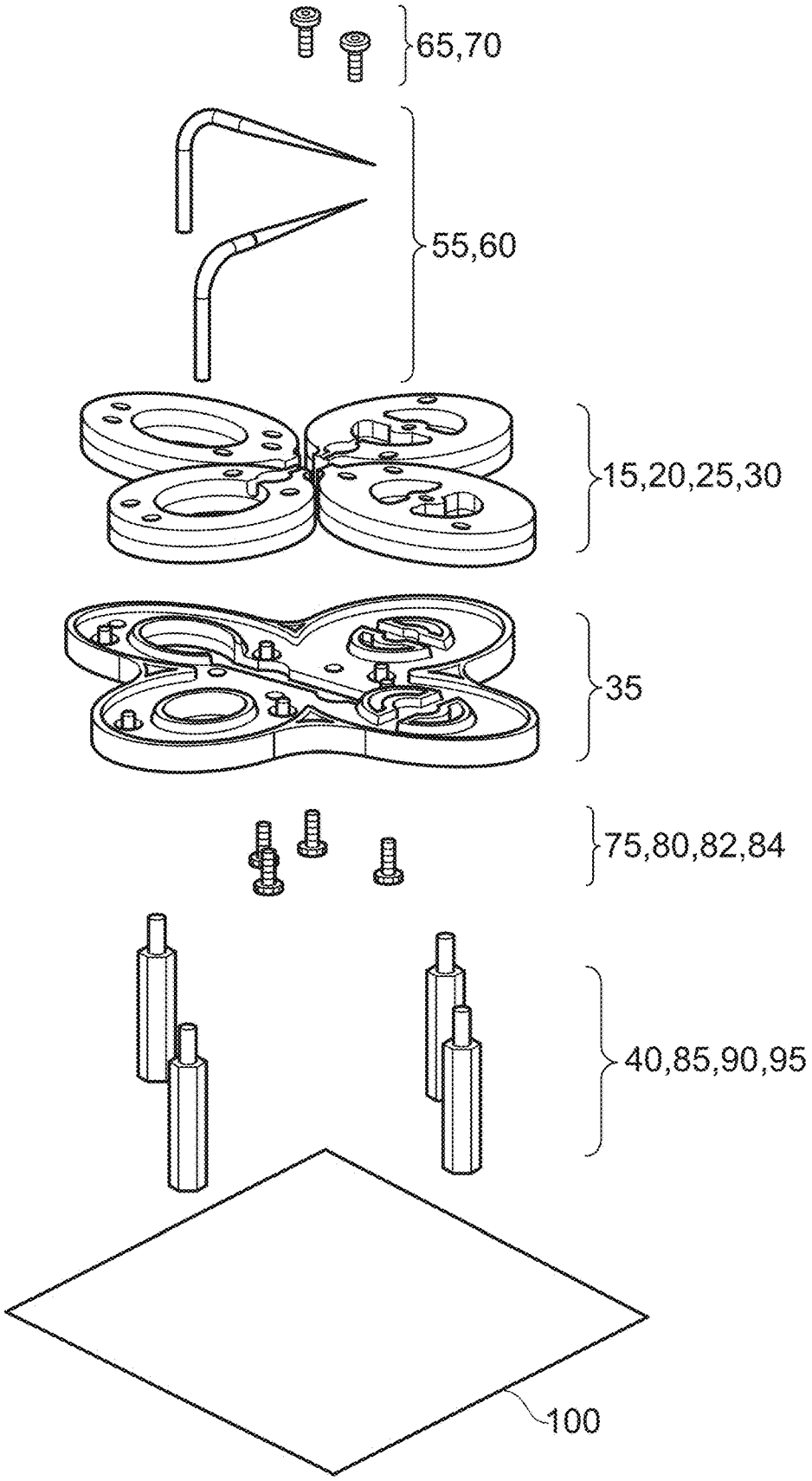
FIG. 2 provides an exploded view of the dual polarised dipole antenna of FIG. 1.

FIG. 2 shows an exploded view of the apparatus of FIG. 1, also showing the underlying metallic plate 100. The exploded view helps to illustrate the assembly process that can be used in order to form the antenna apparatus. Although not shown in FIG. 2, screws will typically be used to connect the bottom of each of the separation rods 40, 85, 90, 95 to the metallic plate 100. It will be appreciated from FIG. 2 that assembly of the antenna apparatus can readily be achieved in a straight forward manner by building up the various layers and screwing the components together, with the coaxial cables forming the feedline cables being routed through the holes provided in the second conductive elements of each dipole antenna.

Figure 3A:
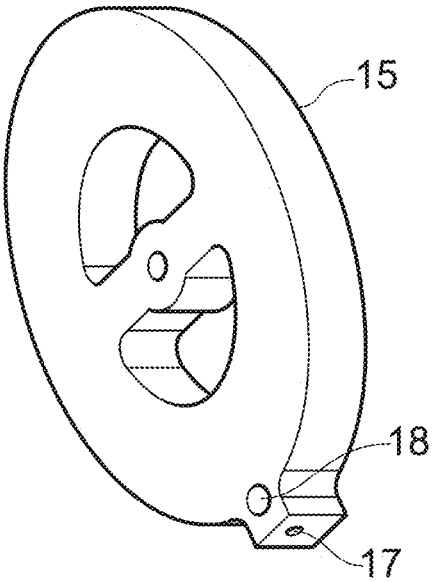
FIGS. 3A and 3B illustrate the design of a pair of conductive elements used to form a dipole antenna.
Figure 3B:
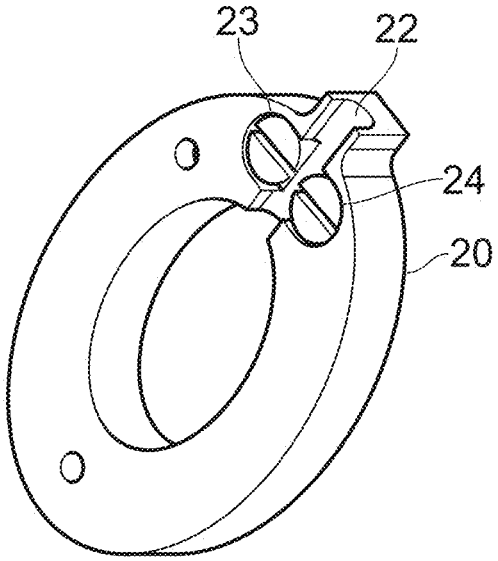

FIGS. 3A and 3B illustrate the first and second conductive elements 15, 20 that may be used in one example implementation. Note these provide a slightly different design for terminating the cables to the design shown in FIGS. 1 and 2. Whilst they are essentially of the same form as those illustrated in FIGS. 1 and 2, in this particular example a pair of screws 23, 24 are used to make the electrical connection between the outer conductor of the coaxial cable and the channel 22 of the second conductive element 20. Within the first conductive element 15, a hole 17 is provided for receiving the inner conductor of the coaxial cable, with a screw being received in the hole 18 in order to make an electrical connection between the inner conductor of the coaxial cable and the first conductive element 15.

Figure 4A:
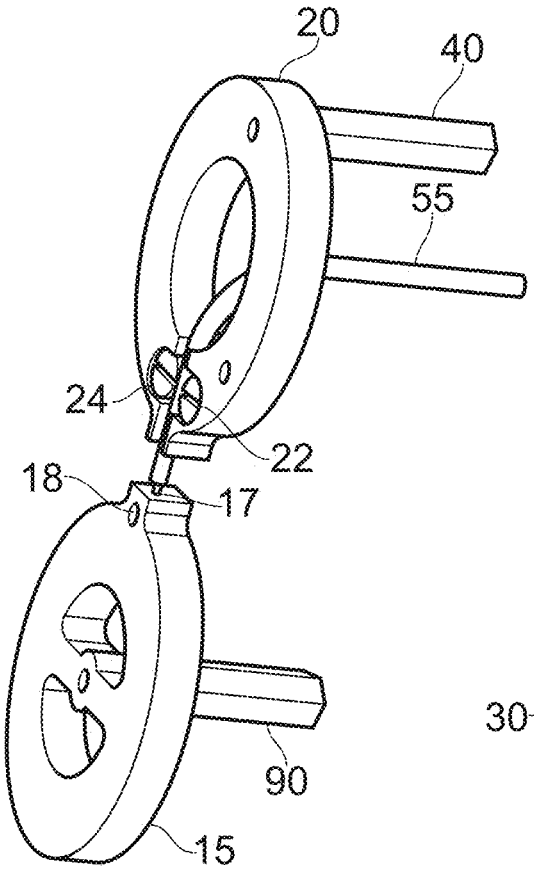
FIGS. 4A and 4B illustrate how a feedline cable can be connected to each dipole antenna in the dual polarised dipole antenna design of FIG. 1 in accordance with one example arrangement.

FIG. 4A illustrates how the feedline coaxial cable 55 is routed into the hole of the second conductive element 20, with the end portion then extending in a plane parallel with the plane formed by the first and second conductive elements 15, 20. The outer conductor of the coaxial cable is clamped to the second conductive element by the screws 22, 24, and the inner conductor then extends into the hole 17 provided in the first conductive element 15. Whilst not shown in FIG. 4A, a screw can then be inserted in the hole 18 to clamp the inner conductor of the coaxial cable in place.

Figure 4B:
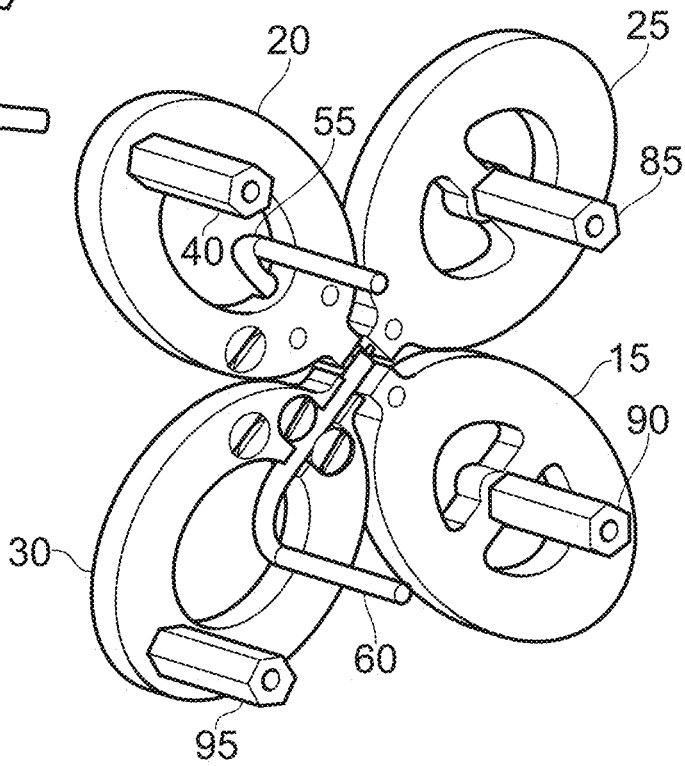

FIG. 4B shows how a pair of dipole antennas can be formed using the arrangement of FIG. 4A, but with the second dipole antenna rotated 90° with respect to the first. The first and second conductive elements 25, 30 of the second dipole antenna can be inverted within the plane containing the four conductive elements, so that the coaxial cables used as the feedline cables for the two dipole antennas can pass over each other. Whilst in the example of FIGS. 3A to 4B, the first conductive element 15 only includes a single hole 17 that is offset from the centre in the depth dimension, in an alternative implementation two holes could be machined within the end face of the first conductive element in the depth dimension, so that there is a suitable hole that can be used to receive the inner conductor of the coaxial cable without needing to invert the first conductive element. Hence, if the second conductive element is not inverted, the first conductor of the coaxial cable could be received in the upper hole in the first conductive element, whereas if the second conductive element is inverted and the first conductive element remains uninverted, the inner conductor of the coaxial cable can be received in the bottom hole.

In the examples discussed thus far, the conductive elements are formed as conductive rings that are solid in the depth dimension, i.e. perpendicular to the second plane containing the four conductive elements shown in FIG. 1. Such conductive elements will be referred to herein as a "solid" implementation, and can be formed by a variety of different manufacturing processes, for example a diecast process or CNC machining. Once a tool/mould has been made, the design becomes very cost effective in mass production.

Figure 5A:
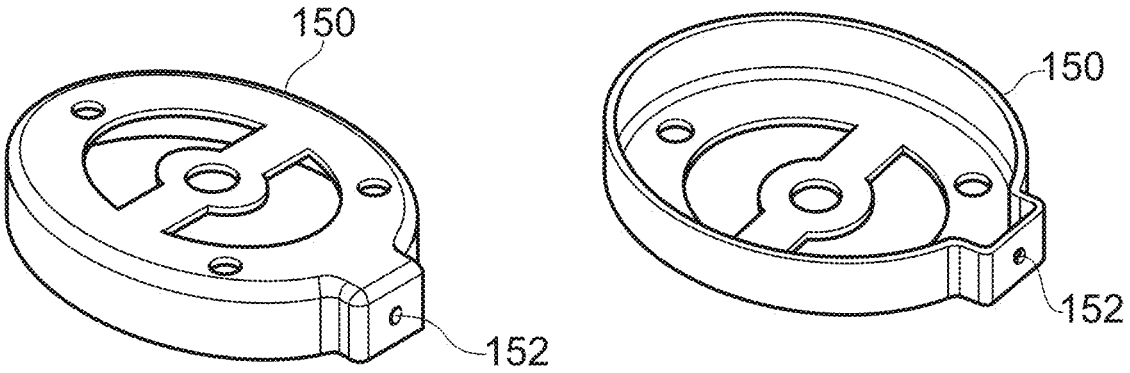
FIGS. 5A and 5B illustrate an alternative form of the pair of conductive elements used to form a dipole antenna in accordance with one example arrangement.
Figure 5B:
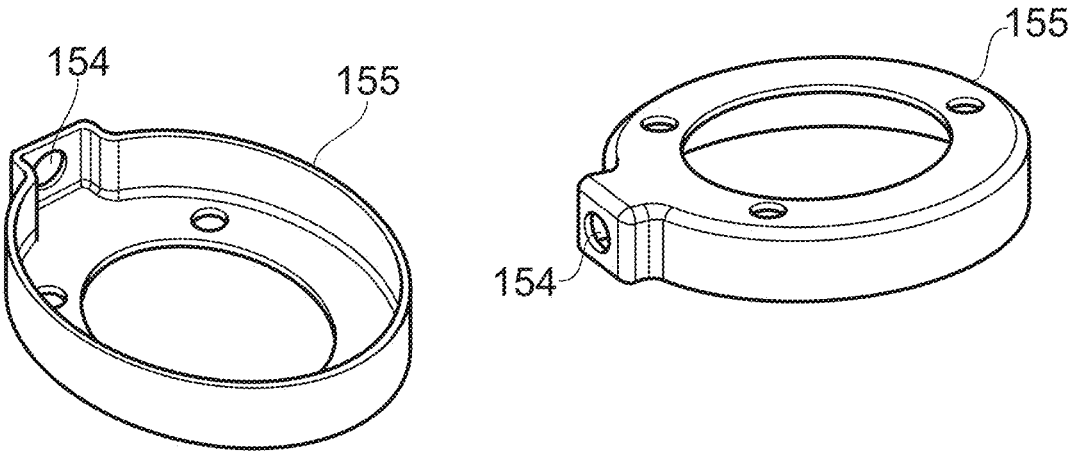

However, as shown in FIGS. 5A and 5B, a functionally equivalent pair of conductive elements 150, 155 can be formed where the conductive rings are not solid in the depth dimension. The holes 152, 154 are provided to accommodate the routing of the coaxial cable. Such a design lends itself to being manufactured using a stamping or pressing technology. From a comparison with FIG. 1, it will be seen that these components adopt a very similar shape to the components shown in FIG. 1, but with the interior of the conductive elements being hollowed out. Due to the physical principle derived from Coulomb's law, the electrical field inside the metal is zero, and hence the dipole arms 150, 155 may operate essentially identically to the solid dipole arms shown in the earlier examples of FIGS. 1 to 4B, producing essentially the same radiation pattern. By manufacturing these components using a stamping process, this can further reduce the cost since, for example, a standard process used to make shielding cans can be employed.

Figure 6B:
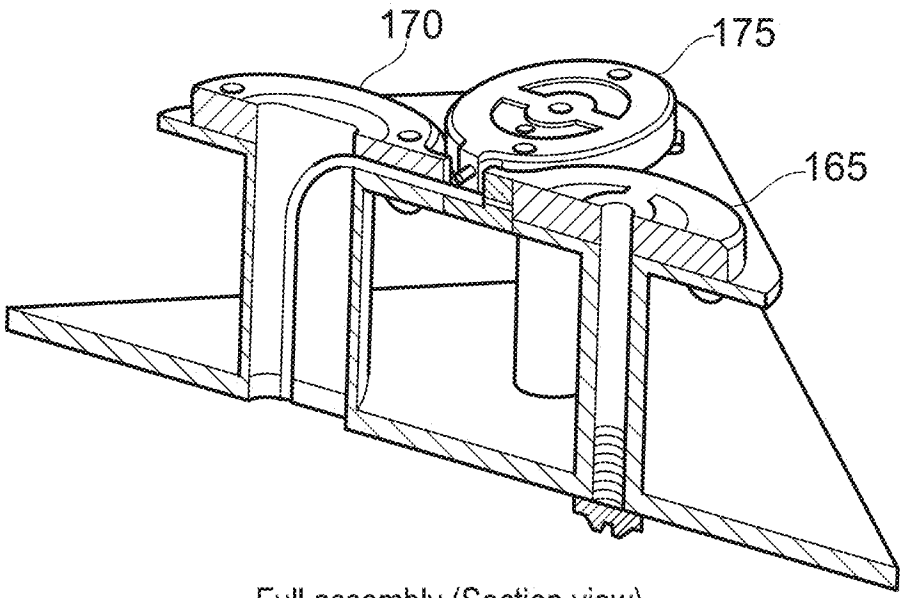
FIGS. 6A and 6B illustrate an implementation of a dual polarised dipole antenna apparatus using the pair of conductive elements illustrated in FIGS. 5A and 5B.
Figure 6A:
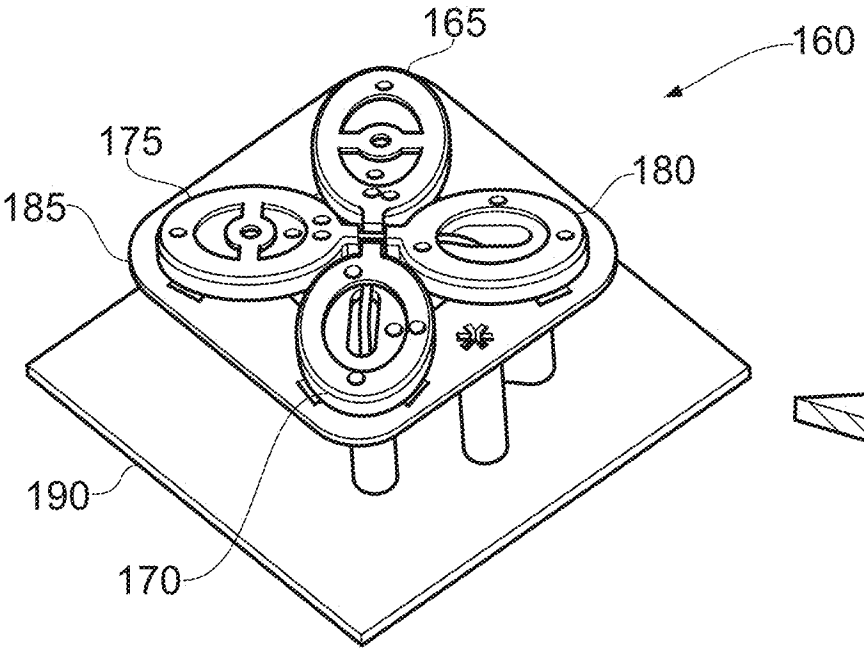

FIGS. 6A and 6B illustrate how the dipole antenna arms of FIGS. 5A and 5B can be deployed in order to form an equivalent dual polarised dipole antenna apparatus to that shown in FIG. 1. It should be noted however that the holes 152, 154 shown in FIGS. 5A and 5B are illustrated being centrally located in the depth dimension, since it is envisaged that the specific example shown in FIGS. 5A and 5B would be used when forming a single dipole antenna. When producing a dual polarised dipole antenna as shown in FIGS. 6A and 6B, these holes can be offset from the central position in the depth dimension, so that essentially two different variants are produced, one for forming the first dipole antenna and one for forming the second dipole antenna. In particular, it will be appreciated that it is not appropriate to invert either one of the dipole antenna arms when using the stamped version, as the metallic ring needs to face in the same direction for all four of the dipole antenna arms.

As shown in FIGS. 6A and 6B, a first dipole antenna is formed by the first and second conductive elements 165, 170, and a second dipole antenna is formed by the equivalent first and second conductive elements 175, 180. The four conductive elements are supported on a non-conductive base 185, which as before can be made of plastic, and in turn that plastic support is separated from the metallic plate 190. As with the FIG. 1 example, a series of rods can be used to achieve the separation, and metallic rods will be used to make the connection between the metallic plate 190 and the conductive bridge provided in both of the first conductive elements 165, 175. In the particular example shown in FIGS. 6A and 6B, the non-conductive inner area is not empty, but instead is filled with non-conductive material, and if desired one of the non-conductive separation structures used to separate the metallic plate 190 from the plastic support base 185 can be hollowed so as to provide a route for the coaxial cable, as shown in FIG. 6B.

Figure 7:
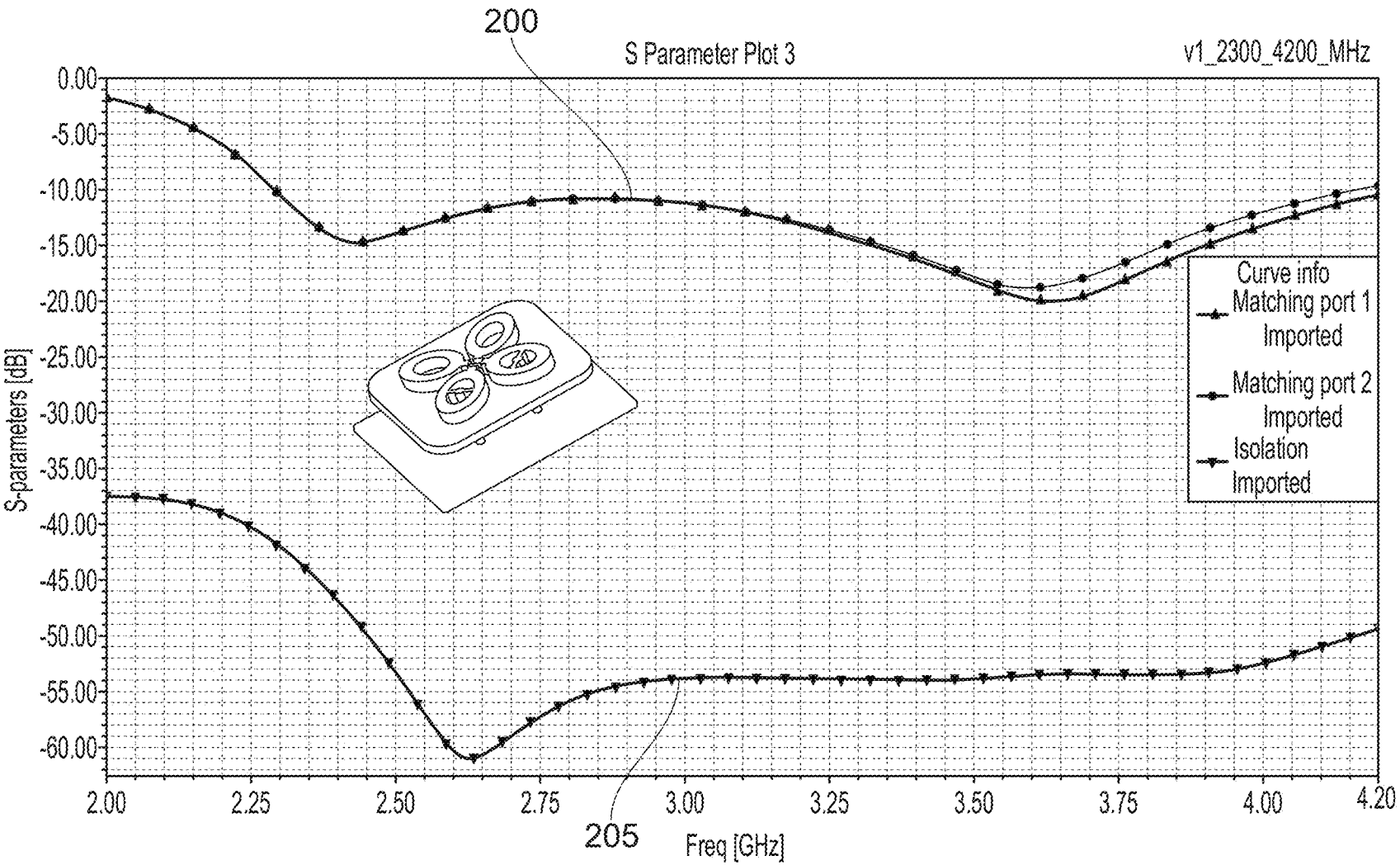
FIGS. 7 and 8 provide performance charts for a dual polarised dipole antenna conforming to the design of FIG. 1.

It has been found that by adopting the dipole antenna design described herein, a wide operational bandwidth performance can be achieved. This is illustrated by the performance charts shown in FIGS. 7 and 8, which are based on the use of the design shown in FIG. 1. FIG. 7 shows return losses (see line 200) and isolation (see line 205) between the antenna ports of the dual polarised dipole antenna versus frequency.

Assuming an input impedance matching level better than −10 dB is desired, the line 200 shows that the antenna can cover a wide frequency range between approximately 2.3 and 4.2 GHz. Further, over this range, the isolation is better than 37 dB, as shown by the line 205. Hence, it can be seen that the relative bandwidth approaches 58% in one example when it is covering the range from 2.3 to 4.2 GHz. Further, this can be scaled for example to 1.7 to 2.7 GHz or any other RF frequencies.

Figure 8:
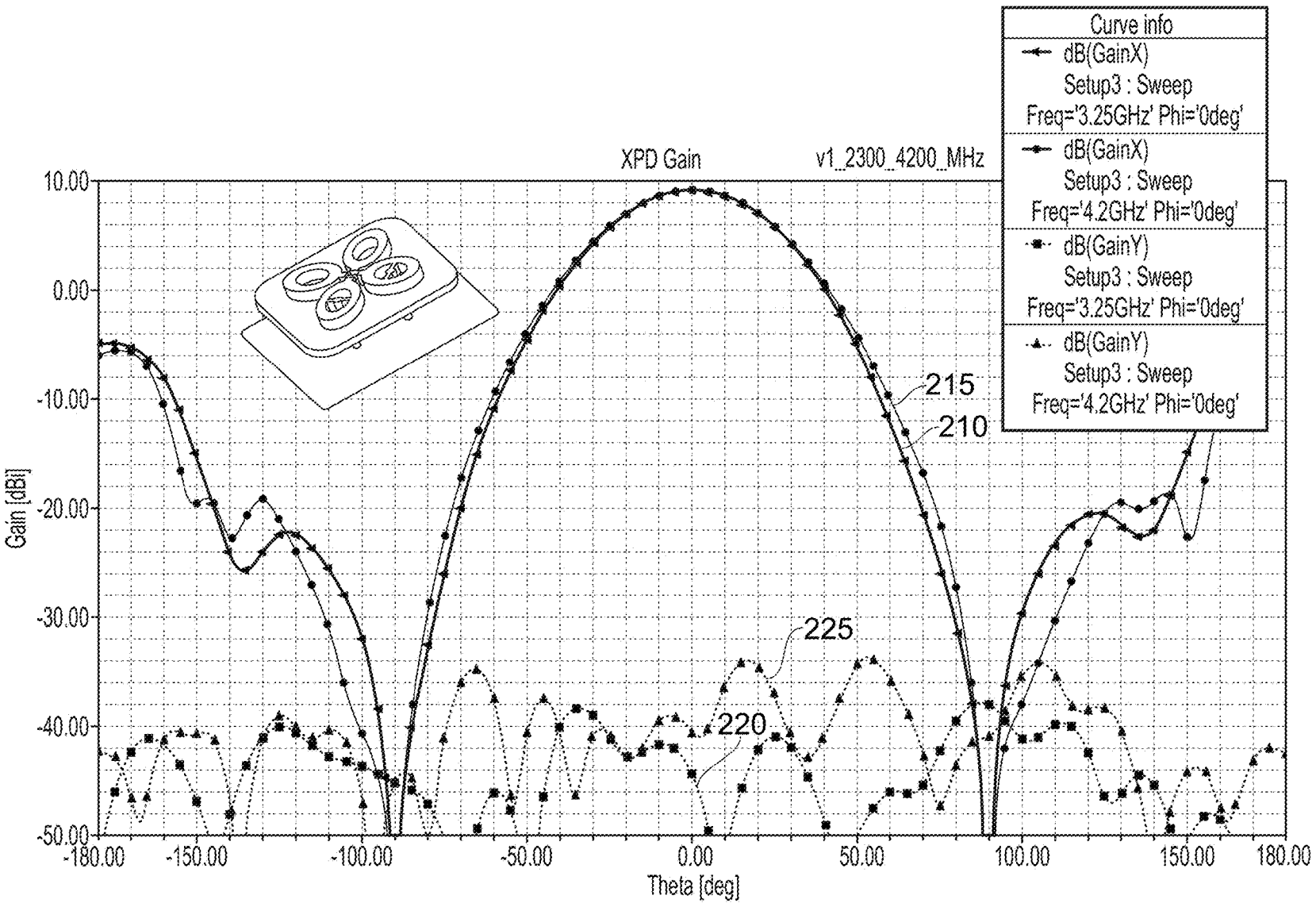

In addition, the antenna directivity has been found to be equivalent to any aperture with the same size. However, since the radiator includes only metallic parts, the radiation efficiency is relatively high (greater than 90%) due to the absence of dielectric losses. Further, it has been found that the isolation between both antenna ports of the dual polarised antenna is better than 37 dB across the operational frequency band, and this is reflected with very good polarisation discrimination as shown in FIG. 8. In FIG. 8, the solid lines 210, 215 represent co-polarisation at two different operational frequencies and the dashed lines 220, 225 represent cross polarisation at the same two frequencies. The cross polarisation discrimination is given by the separation between the solid and dotted lines, and it can be seen that in this example the cross polarisation discrimination (XPD) is better than 40 dB across the operational frequency band of 3.25 to 4.2 GHz.

Referring to the terms used in FIG. 8, GainX is the antenna gain (relative to the directivity) in the X direction (horizontal), and GainY is the antenna gain in the Y direction (vertical). The XPD is the ratio of both components. For example, the figure shows the patterns of the horizontal polarised antenna, and hence XPD is equal to GainX−GainY.

Whilst in the above examples, a dual polarised dipole antenna design has been considered, the same principles can be used for a single dipole antenna apparatus. FIGS. 9A to 9F illustrate an example implementation of such a single dipole antenna apparatus, when using conductive elements of the form shown in FIGS. 5A and 5B. Hence, a first conductive element 305 and a second conductive element 310 are supported on a non-conductive base 315, for example a plastic base, which itself is suspended above a metallic plate 335 by the rods 325, 330. The rod 325 is slightly longer than the rod 330, since it extends through the plastic plate 315 in order to make contact with the underside of the conductive bridge provided in the first conductive element 305. A metallic screw 340 is then used to make a solid connection between the conductive bridge and the metallic rod 325. Similarly, a screw 345 is used to connect the bottom surface of the metallic rod to the metallic plate 335. Screws 350, 355 can also be used to connect the non-conductive rod 330 between the plastic support structure 315 and the metallic plate 335.

Figure 9A:
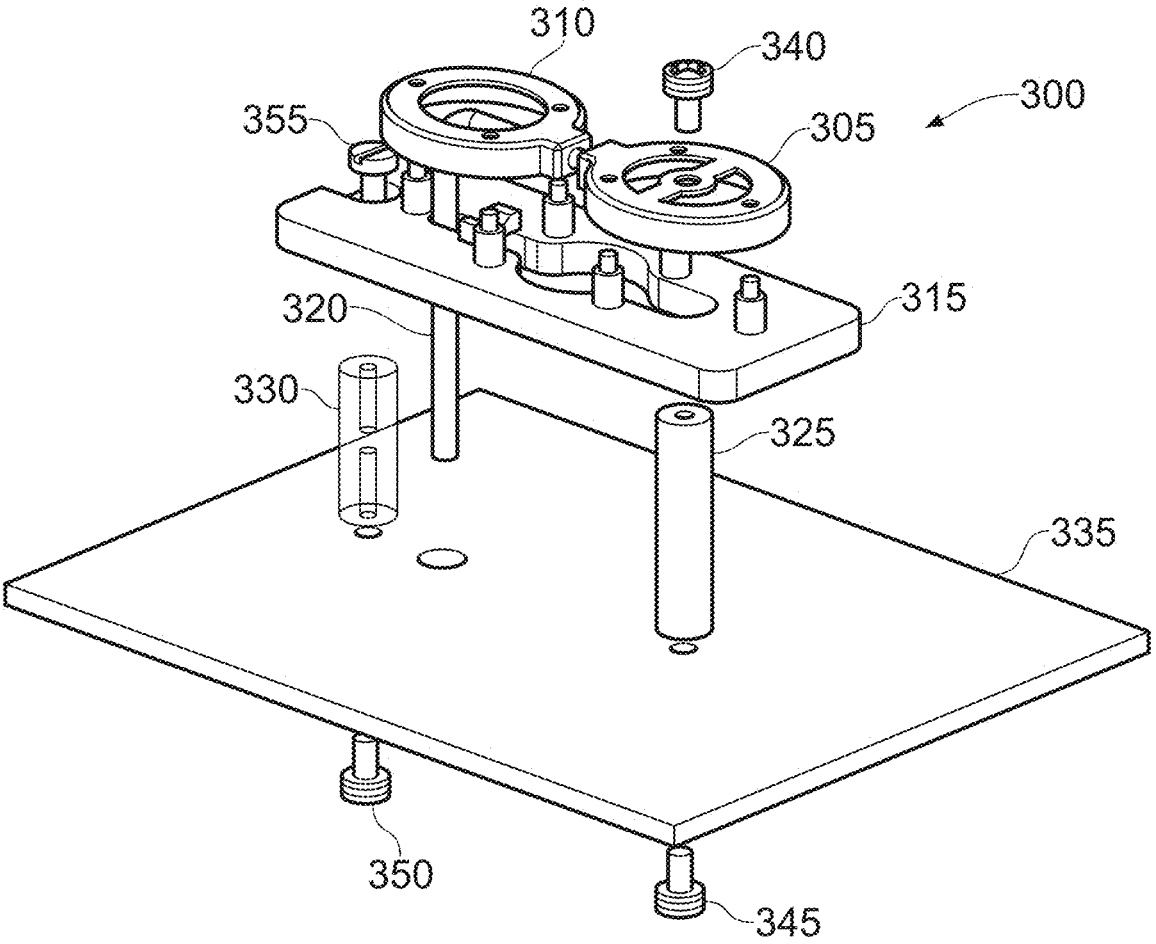
FIGS. 9A to 9F are diagrams illustrating a dipole antenna design according to one example configuration.
Figure 9B:
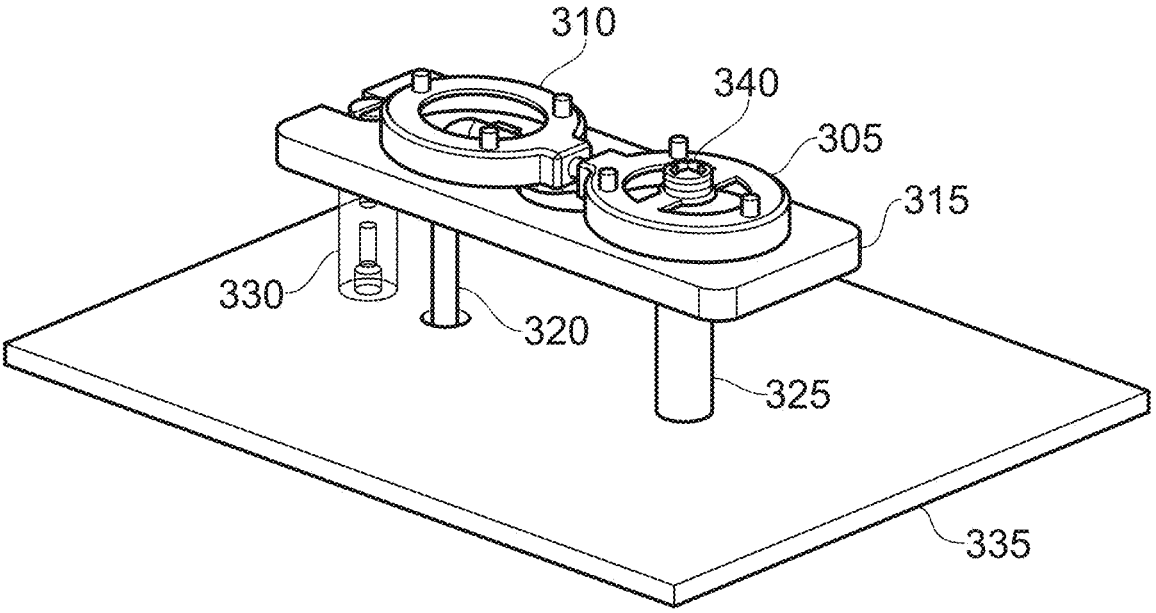
Figure 9C:
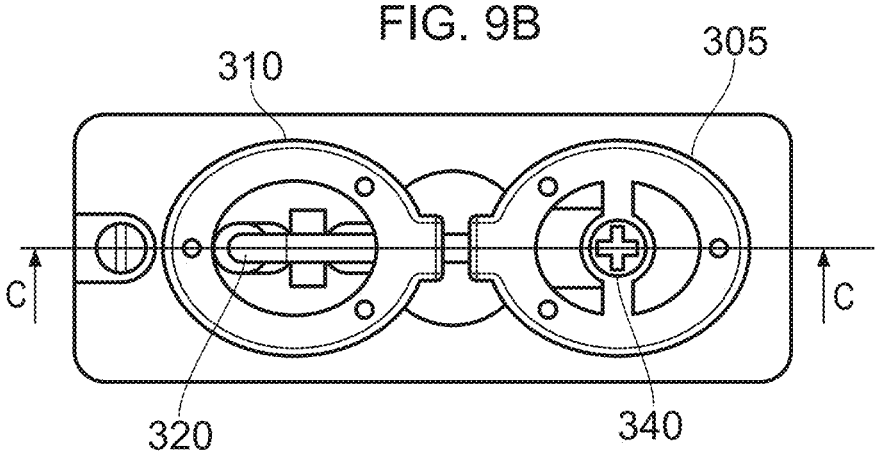
Figure 9D:
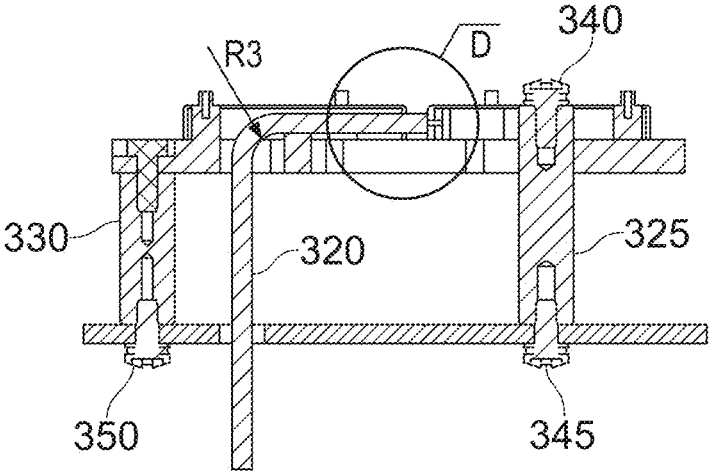
Figure 9E:
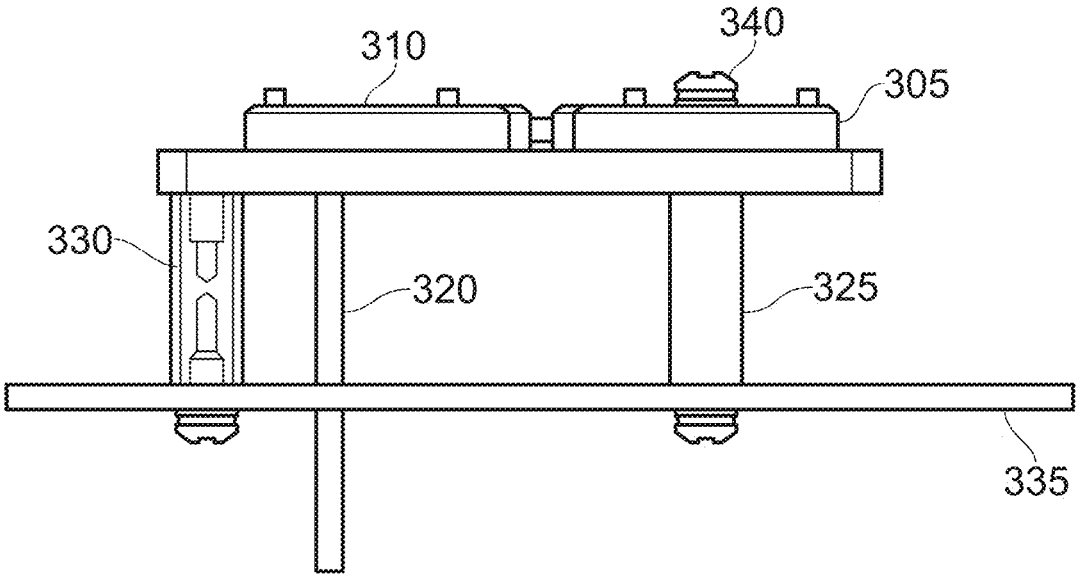
Figure 9F:
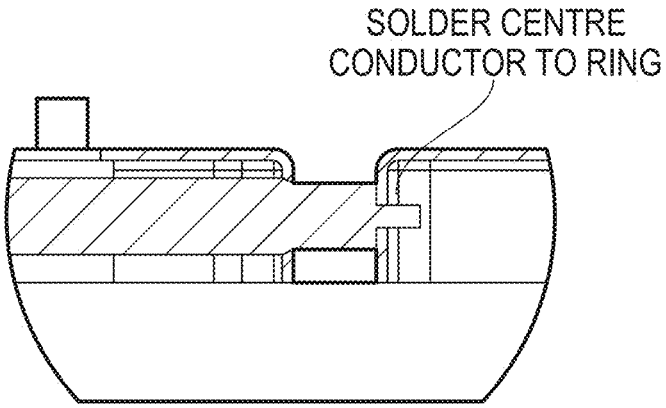

Whilst FIG. 9A shows an exploded view, FIG. 9B shows a view of the antenna apparatus once all the parts have been assembled. FIG. 9C shows a view from above, and in particular shows how the coaxial cable 320 is routed so that the end portion lies in a parallel plane to the plane formed by the conductive elements 305, 310. This is shown in more detail in FIG. 9D, and FIG. 9F shows a close up view of the portion D shown in FIG. 9D. A soldering connection can be used to connect the inner conductor of the coaxial cable to the ring forming the first conductive element 305. Similarly a soldering connection can also be used to make an electrical connection between the outer conductor of the coaxial cable and the second conductive element 310. FIG. 9E shows a side on view of the apparatus of FIG. 9B for completeness.

Figure 10:
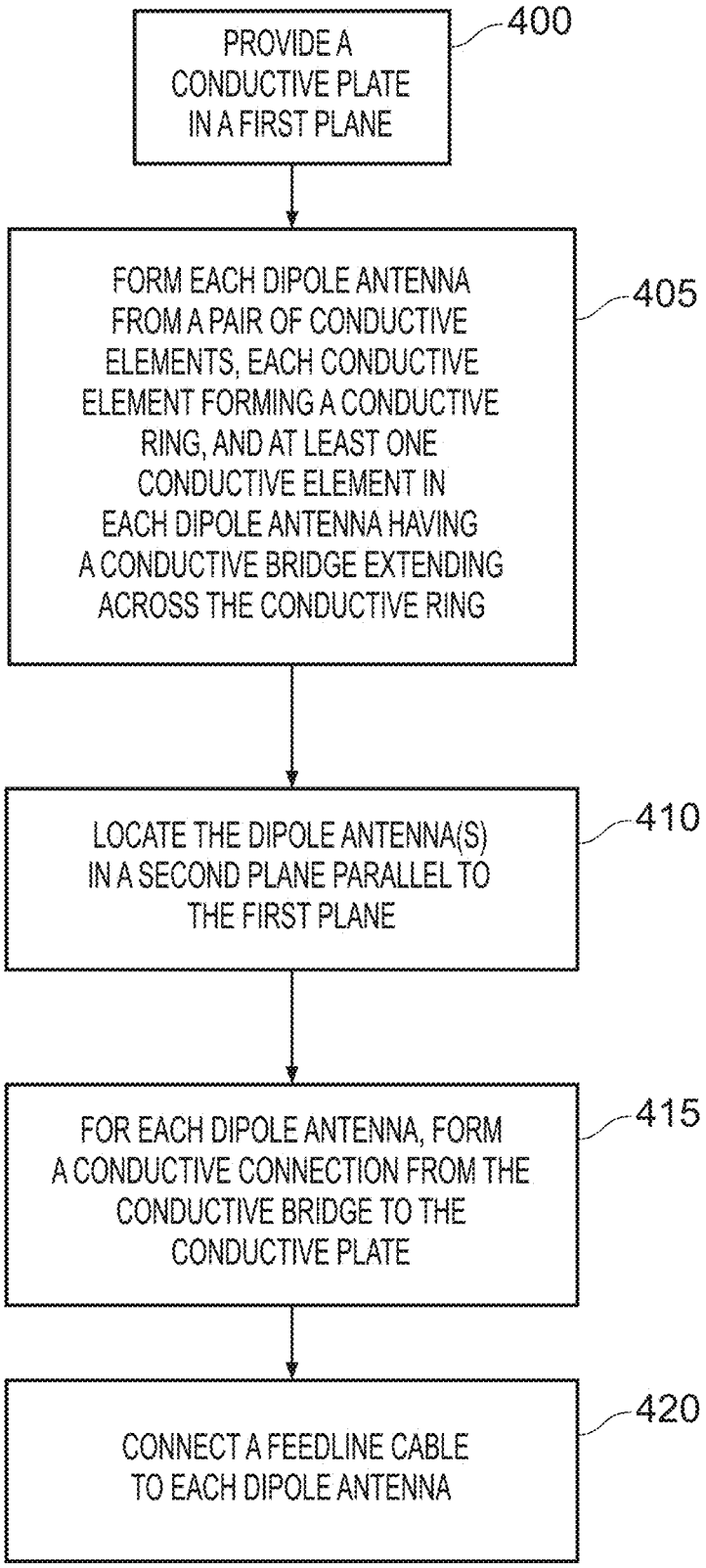
FIG. 10 is a flow diagram illustrating steps taken during the manufacture of a dipole antenna apparatus in accordance with the techniques described herein.

FIG. 10 is a flow diagram illustrating steps performed during the manufacture of an antenna apparatus as described in the preceding figures. At step 400, a conductive plate is provided in a first plane, and then at step 405 each dipole antenna is formed from a pair of conductive elements, where each conductive element forms a conductive ring and at least one conductive element in each dipole antenna has a conductive bridge extending across the conductive ring.

At step 410, each dipole antenna is located in a second plane parallel to the first plane, for example by mounting the conductive elements on a suitable base support. At step 415, for each dipole antenna, a conductive connection is formed from the conductive bridge to the conductive plate, and then at step 420 a feedline cable is connected to each dipole antenna.

It has been found that by adopting the antenna design described with reference to the examples illustrated herein, a dipole antenna topology is provided that is compact in terms of size compared to other existing antenna designs, and incorporates DC grounding as part of the design without requiring additional components. In particular, the conductive plate provided to act as a reflector during normal use of the antenna can also be used as a ground plane for direct current within the first conductive element of the dipole antenna, by providing that first conductive element with a conductive bridge that is then connected to the conductive plate via a conductive connection. In order to reduce the number of parts, that conductive connection can be provided by one of the components used to form a separation structure between the dipole antenna arms and the conductive plate.

It has been found that the design provides a wide operational bandwidth performance. Further, when adopting the dual polarised antenna design, it has been found that very good polarisation discrimination can be obtained.

The illustrated design can be used in a wide variety of different implementations, and can for example be used as an element of a bigger antenna array, for example to facilitate beamforming operations. Depending on the implantation technology, the proposed design may also provide a good power handling and passive intermodulation products (PIM) which is a significant technical challenge for antenna designers.

Although particular embodiments have been described herein, it will be appreciated that the invention is not limited thereto and that many modifications and additions thereto may be made within the scope of the invention. For example, various combinations of the features of the following dependent claims could be made with the features of the independent claims without departing from the scope of the present invention.

The invention claimed is:

1. An antenna apparatus comprising:

a conductive plate extending in a first plane;

a pair of conductive elements arranged to form a dipole antenna, the pair of conductive elements located in a second plane parallel to the first plane, and each conductive element forming a conductive ring in the second plane that surrounds a non-conductive inner area;

a first conductive element in the pair of conductive elements having a conductive bridge extending across the conductive ring to divide the non-conductive inner area into at least two portions; and a conductive connection extending from the conductive bridge to the conductive plate;

whereby in normal use the conductive plate acts as a reflector for the dipole antenna, but in the event of a direct current event the presence of the conductive bridge and the conductive connection causes the conductive plate to operate as a ground plane for direct current within the first conductive element of the dipole antenna.

2. An antenna apparatus as claimed in claim 1, further comprising:

a separation structure to hold the pair of conductive elements apart from the conductive plate, and the conductive connection is provided by the separation structure.

3. An antenna apparatus as claimed in claim 2, where the separation structure provides a metallic rod extending from the conductive plate to the conductive bridge to provide the conductive connection.

4. An antenna apparatus as claimed in claim 3, wherein:

the pair of conductive elements are located on a non-conductive support structure; and the metallic rod is shaped so as to clamp the non-conductive support structure between an abutment surface of the metallic rod and the first conductive element whilst a portion of the metallic rod extends through the non-conductive support structure to connect to the conductive bridge of the first conductive element.

5. An antenna apparatus as claimed in claim 1, wherein:

a second conductive element in the pair of conductive elements is not provided with the conductive bridge; and the first and second conductive elements are shaped in the second plane such that the first conductive element has an equivalent electrical length to the second conductive element despite the provision of the conductive bridge in the first conductive element.

6. An antenna apparatus as claimed in claim 5, wherein:

during operation surface current flows through the first and second conductive elements;

the first and second conductive elements have a fundamental current mode defined by the conductive ring;

the presence of the conductive bridge creates at least one additional current mode in the first conductive element; and the first conductive element is shaped so as to restrict an effect of the at least one additional current mode on the electrical length of the first conductive element.

7. An antenna apparatus as claimed in claim 1, wherein:

a feedline cable is routed into the non-conductive inner area of one of the conductive elements in the pair of conductive elements.

8. An antenna apparatus as claimed in claim 7, wherein:

a second conductive element in the pair of conductive elements is not provided with the conductive bridge, and the feedline cable is routed into the non-conductive inner area of the second conductive element.

9. An apparatus as claimed in claim 8, wherein:

an end portion of the feedline cable that is used to make electrical connections with both the first and second conductive elements is arranged to extend parallel to the second plane;

the second conductive element has a channel provided therein to accommodate a first part of the end portion of the feedline cable, and an electrical connection is made between the second conductive element and the first part in the channel; and a second part of the end portion of the feedline cable extends beyond the channel to make an electrical connection to the first conductive element.

10. An apparatus as claimed in claim 9, wherein:

a mechanical fixing mechanism is used to make the electrical connections of the feedline cable to the first and second conductive elements.

11. An apparatus as claimed in claim 7, wherein:

an end portion of the feedline cable that is used to make electrical connections with both the first and second conductive elements is arranged to extend parallel to the second plane.

12. An apparatus as claimed in claim 7, wherein the feedline cable is a coaxial cable comprising an inner conductor and an outer conductor insulated from the inner conductor, and the inner conductor is electrically connected to the first conductive element.

13. An apparatus as claimed in claim 1, wherein the conductive rings are solid in a depth dimension of the first and second conductive elements perpendicular to the second plane.

14. An apparatus as claimed in claim 1, wherein the first and second conductive elements have an edge defining an element depth in a depth dimension perpendicular to the second plane, and the conductive rings are provided by a surface region of the first and second conductive elements, where the surface region has a depth less than the element depth.

15. An antenna apparatus as claimed in claim 1, wherein the dipole antenna is a first dipole antenna, and the antenna apparatus further comprises:

an additional dipole antenna comprising a pair of conductive elements that are also located within the second plane;

wherein the additional dipole antenna has a different orientation within the second plane than the first dipole antenna so as to provide a dual-polarised antenna apparatus.

16. An antenna apparatus as claimed in claim 15, wherein the pair of conductive elements forming the additional dipole antenna are constructed identically to the pair of conductive elements forming the first dipole antenna.

17. An antenna apparatus as claimed in claim 16, wherein:

the pair of conductive elements have a depth dimension perpendicular to the second plane, and at least one of the pair of conductive elements has a feedline cable receiving structure offset from a central location in the depth dimension;

the at least one of the pair of conductive elements forming the additional dipole antenna is inverted with respect to the corresponding at least one of the pair of conductive elements forming the first dipole antenna to facilitate connection of a first feedline cable to the first dipole antenna and connection of a second feedline cable to the additional dipole antenna such that end portions of both the first and second feedline cables extend parallel to the second plane but are separated with respect to each other by a determined distance perpendicular to the second plane.

18. A method of constructing an antenna apparatus comprising:

providing a conductive plate extending in a first plane;

positioning a pair of conductive elements in a second plane parallel to the first plane to form a dipole antenna, and shaping each conductive element so as to form a conductive ring in the second plane that surrounds a non-conductive inner area;

providing a first conductive element in the pair of conductive elements with a conductive bridge extending across the conductive ring to divide the non-conductive inner area into at least two portions; and forming a conductive connection extending from the conductive bridge to the conductive plate, such that in normal use the conductive plate acts as a reflector for the dipole antenna, but in the event of a direct current event the presence of the conductive bridge and the conductive connection causes the conductive plate to operate as a ground plane for direct current within the first conductive element of the dipole antenna.

* * * * *